United States Patent [19]

Mueller

[11] Patent Number: 4,467,966

[45] Date of Patent: Aug. 28, 1984

[54] FUEL-INJECTING VALVE FOR INTERNAL COMBUSTION ENGINE

[75] Inventor: Eckart Mueller, Schwabach, Fed. Rep. of Germany

[73] Assignee: M.A.N. Maschinenfabrik Augsburg-Nürnberg Aktiengesellschaft, Nüremberg, Fed. Rep. of Germany

[21] Appl. No.: 322,256

[22] Filed: Nov. 17, 1981

Related U.S. Application Data

[63] Continuation of Ser. No. 115,948, Jan. 28, 1980, abandoned.

[30] Foreign Application Priority Data

Jan. 23, 1979 [DE] Fed. Rep. of Germany ..... 2902417

[51] Int. Cl.[3] ..... F02M 61/06; F02M 61/18

[52] U.S. Cl. ..... 239/533.4

[58] Field of Search ..... 239/533.2–533.12, 239/584

[56] References Cited

FOREIGN PATENT DOCUMENTS

| | | | |
|---|---|---|---|
| 662061 | 7/1938 | Fed. Rep. of Germany | 239/533.12 |
| 2902417 | 7/1980 | Fed. Rep. of Germany | 239/533.2 |
| 899598 | 6/1945 | France | 239/533.12 |

*Primary Examiner*—Andres Kashnikow

*Attorney, Agent, or Firm*—Peter K. Kontler

[57] ABSTRACT

A valve is provided comprising a nozzle body formed with an internal space having an axis and a single valve seat adapted to receive fuel under pressure. It further includes a single nozzle needle movable in said space relative to and axially of said valve seat; and means including a single spray passage communicating with said valve seat for discharging from said nozzle body a jet of fuel having a spray pattern and an angular orientation relative to said axis which varies as a function of the distance of the single needle from the single valve seat.

4 Claims, 9 Drawing Figures

FUEL-INJECTING VALVE FOR INTERNAL COMBUSTION ENGINE

RELATED APPLICATION

This is a continuation of parent application Ser. No. 115,948, filed Jan. 28, 1980, now abandoned.

BACKGROUND OF THE INVENTION

This invention relates to a valve.

More particularly, the invention relates to a fuel-injecting valve for internal combustion engines which is provided with an axially slidable nozzle needle which is capable of being lifted off its valve seat by the pressure of the fuel with the nozzle body being formed with a spray hole disposed in the nozzle body at an acute angle relative to the nozzle axis.

An injector of this type is disclosed in German Patent Application P 2746 010.2. The injector according to that disclosure has the nozzle needle formed with a point below the valve seat which penetrates into the spray hole at least in the closed and partially closed positions, so that the free cross-sectional area of the spray hole is smaller than the free cross-sectional area at the valve seat in nearly all positions of the nozzle needle.

The purpose of this combination is to provide control of the free cross-sectional area at the valve seat together with simultaneous control of the free cross-sectional area directly at the spray hole; this assures that fuel pressure at the spray hole is available substantially undiminished throughout the complete injection cycle. As a result, mixture formation and, consequently, combustion, are improved in all operating modes of the engine, especially in the low speed and low load modes. Futhermore, there is and improvement in exhaust gas quality and a reduction of fuel consumption.

Further essential factors for the quality of mixture formation in the combustion chamber of an internal combustion engine are the fuel jet orientation, the fuel jet characteristics, as well as the utilization of the kinetic energy at the valve seat.

It has been well known in the art for a long time that it is most advantageous during starting as well as in the low load and/or speed ranges of the engine to have a relatively high degree of direct contact fuel/air mixing which is obtainable by increased atomization of the fuel spray and a spray orientation directed directly into the combustion chamber air for combustion, whereas a compact fuel jet positioned in a direction closer to the combustion chamber wall is desirable in the upper load and/or speed ranges in order to prevent dangerous peak pressures as a result of combustion proceeding at too fast a rate. This applies especially to internal combustion engines which employ the method of wall deposition of the fuel, for which purpose a change in direction of the fuel spray or jet is most advantageous.

With a view to meeting these requirements, a number of proposals have been made which, however, all suffered from one drawback or other. For instance, the German Pat. No. 1,014,382 suggested a device for deflecting the fuel spray where a guiding element adapted to be adjusted as a function of the temperature is provided in the region of the fuel spray. This guiding element consists of a bimetallic or similar device and is designed to deflect the fuel towards the center of the combustion chamber while the combustion chamber is cold, whereas the fuel is guided towards the wall when the combustion chamber is warm. This device is strictly temperature-dependent while the fuel spray pattern and the injection pressure are not taken into account. Furthermore, it is most vulnerable to malfunctions.

Alternative proposals whereby the injector is rotated to suit the various load ranges of the engine have failed to find acceptance due to their complexity.

SUMMARY OF THE INVENTION

The general object of the present invention is to improve a fuel injector of the type initially referred, to in a simple manner and without any vulnerable means so that the fuel jet characteristic and fuel jet orientation are automatically varied by the position of the nozzle needle over the full operating range of the engine or part of the operating range, so that optimum mixture formation is achieved while simultaneous taking advantage of the kinetic energy at the needle valve seat.

According to the invention, this object is achieved by adopting an angle between the injector axis and the spray hole axis between 10° and 50° and by selecting the length of the spray hole axis—measured from the area of penetration at the blind hole and/or needle valve seat to the outer face of the nozzle body—in a manner that when looking through the spray hole in the direction of the nozzle axis at least 20% of the full spray hole area appears as a free area, the length of the spray hole axis being smaller than or at most equal to twice the spray hole diameter. A construction of this type ensures that, with a slight lift of the nozzle needle, the fuel passing the needle valve seat at a high velocity will penetrate into the combustion chamber through the spray hole without any substantial deceleration. At the same time, this causes a relatively wide fuel spray or spray cone the maximum density (spray core) of which is at a smaller angle relative to the injector axis than the spray hole axis. As a result, there will be a more pronounced air distribution of the fuel with improved mixture formation and combustion in the lower load range.

With the nozzle needle in the fully open position, the spray hole will form the narrowest flow area so that then nearly the full fuel pressure will exist directly ahead of the spray hole and the fuel will enter the combustion chamber as a compact jet substantially in the direction of the spray hole axis or, where the principle of wall deposition of the fuel is employed in internal combustion engines, reaches the combustion chamber wall as a compact jet substantially in the direction of the spray hole axis.

As a further embodiment of the invention it is proposed to form the outer surface of the nozzle body where the spray hole emerges as a plainface extending perpendicular to the injector axis, or as a symmetrically arranged conical face or, as a plainface extending obliquely to the injector axis, whereby additional means of influencing the fuel spray are obtained because the spray hole can be made with differing lengths on its circumference as a result.

Finally it should be mentioned that the invention is applicable both to injectors having a blind hole recess or without any such recess, i.e. where the spray hole joins the needle valve seat directly. Reference is made to the following description of several typical exemplary embodiments of the invention illustrated in the drawings.

DESCRIPTION OF PREFERRED EMBODIMENTS

Figure 1:
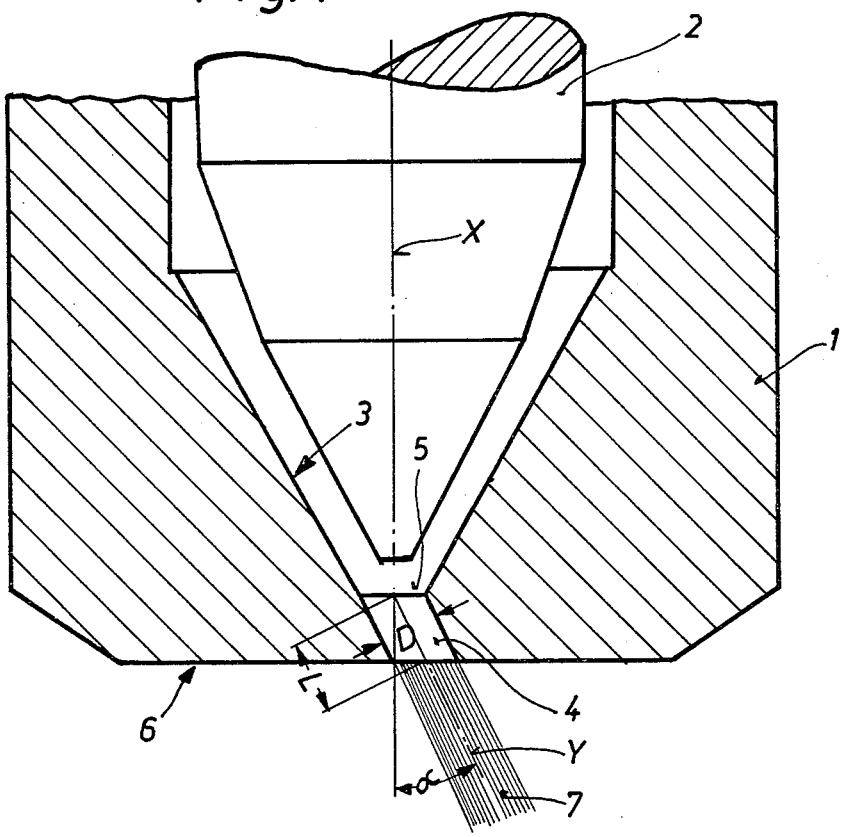
FIG. 1 is a longitudinal section through the lower part of a hole-type injector according to the invention with the nozzle needle shown in the fully open position.

Referring to FIG. 1, a nozzle body 1 is provided with a nozzle needle 2 capable of being moved in the direction of the longitudinal axis x of the injector, the nozzle needle being shown lifted off its needle valve seat 3 and full open. Provided underneath the valve seat 3 is a spray hole 4 disposed at an angle relative to the injector axis x whose spray hole axis y—measured from the penetration area 5 at the valve seat 3 to the outer face 6 of the nozzle body—has a length L which is smaller than twice the spray hole diameter D. The angle $\alpha$, which may amount to between 10° and 50°, has been selected in the example at about 30°. After the nozzle needle 2 has reached the fully open position, the spray hole 4 forms the narrowest flow area so that a compact fuel jet 7 is produced which is positioned in the direction of the spray hole axix y.

Figure 2:
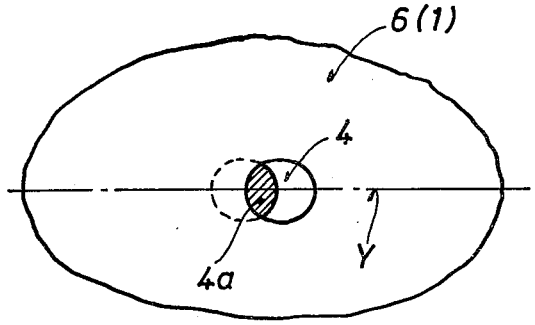
FIG. 2 is a partial view of the injector according to FIG. 1, seen from the bottom.

It can be seen from FIG. 2 that the length of the spray hole axis x and the angle $\alpha$ (FIG. 1) have been selected so that when looking through the spray hole 4 in the direction of the injector axis x at least 20%, and in the present case, even as much as about 50%, of the full spray hole area appears as a free area 4*a* which is shown hatched for better identification.

Figure 3A:
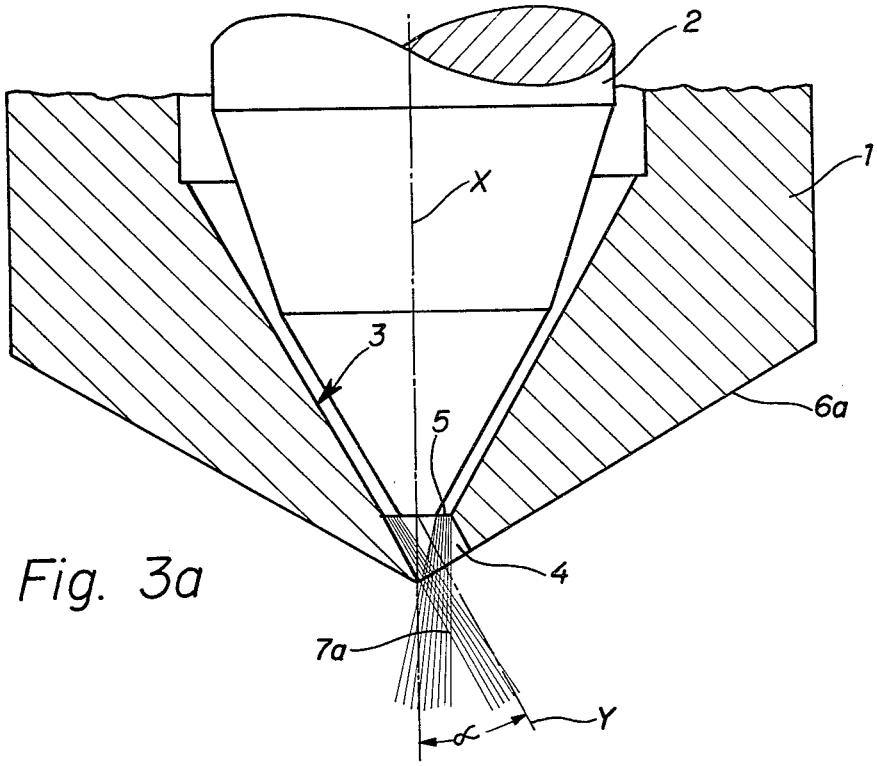
FIGS. 3A and 3B are hole-type injectors according to FIG. 1 with the nozzle needles in a partly open position.

FIG. 3A shows the injector according to FIG. 1, but with the nozzle needle 2 in a partly open position. The fuel passing the valve seat 3 at a high velocity is emitted substantially without any deceleration through the spray hole 4 and, on discharge, produces a relatively wide fuel spray 7*a* or spray cone, the core of which is not shown in the drawing but forms a smaller angle relative to the injector axis x than the angle $\alpha$. In other words, as the nozzle needle 2 opens, a slow deflection of the fuel jet is produced at the same time.

Figure 3B:
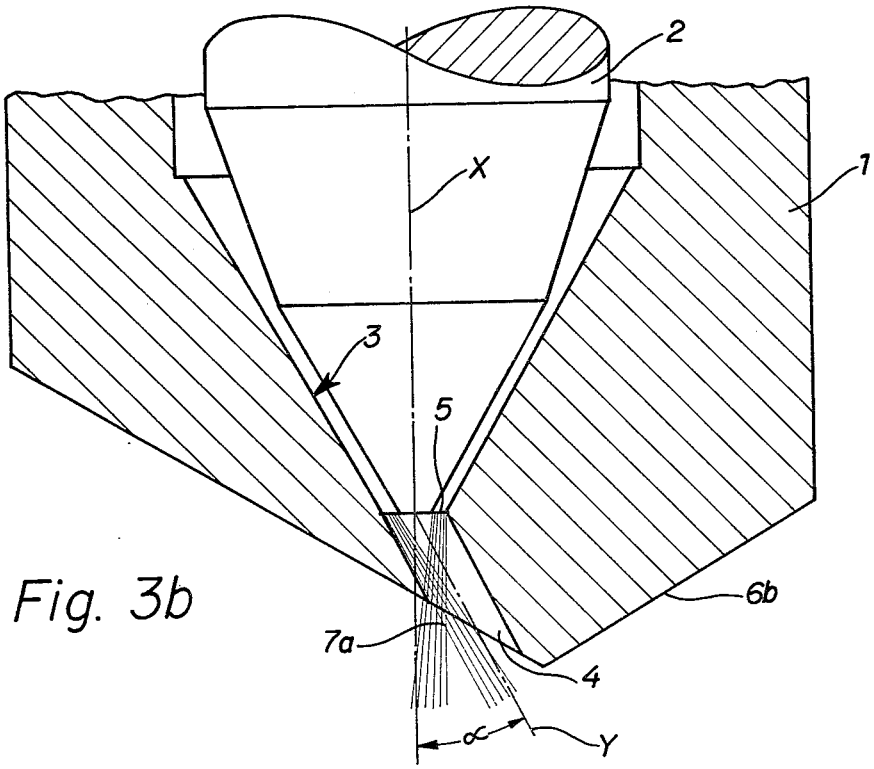

Furthermore, it is indicated in FIG. 3B that the outer face of the nozzle body 1 on which the spray hole 4 opens need not be formed only as a plane face 6 extending perpendicular to the injector axis x, but it may also take the form of a conical face 6*a* disposed symmetrically relative to the injector axis x, or a non-symmetrical conical face 6*b*, or a plane face extending obliquely to the injector axis x.

Figure 4:
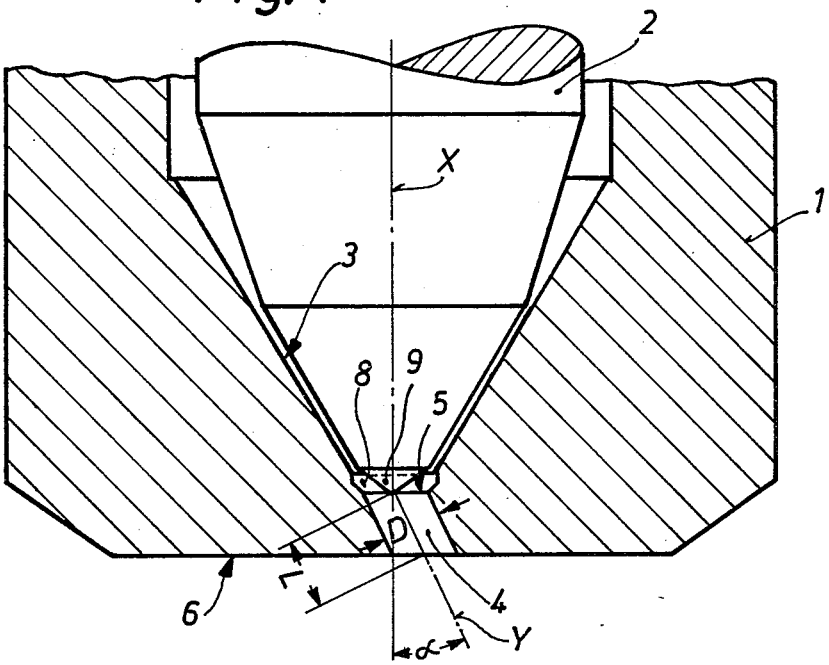
FIG. 4 is a longitudinal section through the lower part of an injector according to the invention, having a nozzle with a blind hole-type recess.
Figure 5:
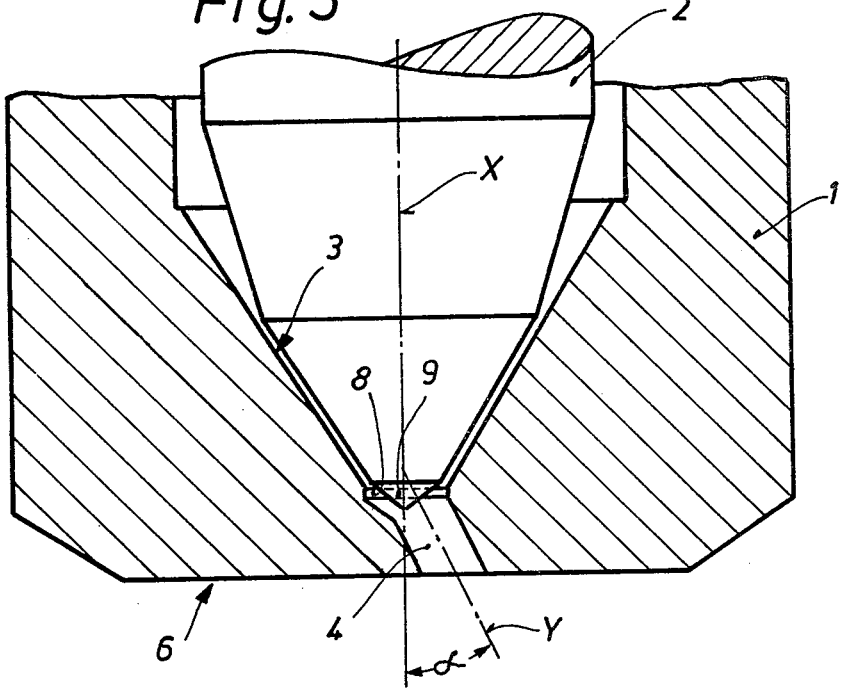
FIG. 5 is a variant of the injector with a blind hole type nozzle according to FIG. 4.
Figure 6:
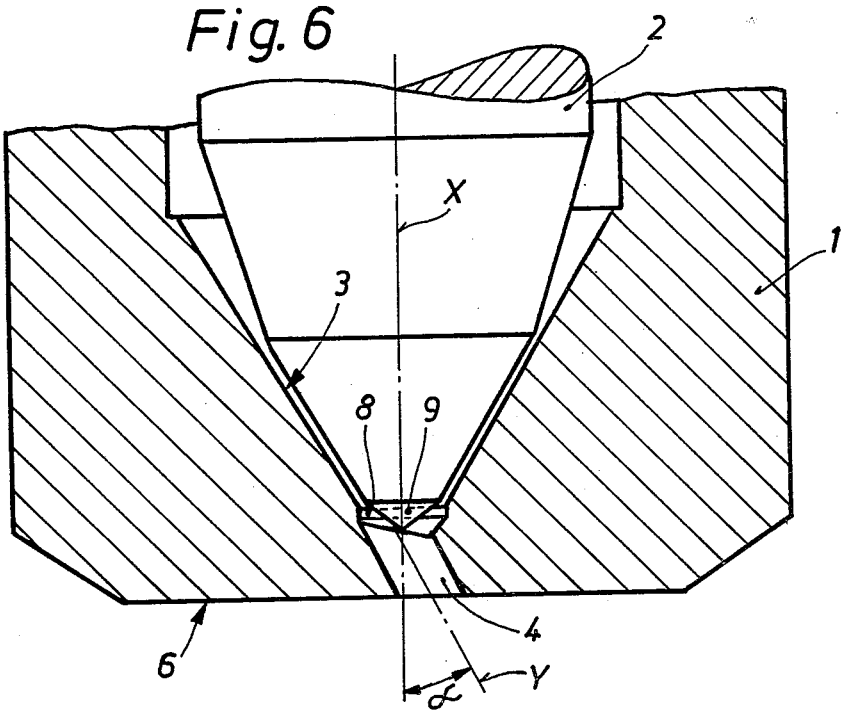
FIG. 6 is a further variant of the injector with a blind hole type nozzle hole according to FIG. 4.

FIGS. 4, 5 and 6 each show nozzles having a blind hole recess with the nozzle needle 2 in a partly open position, their function being the same as that of the hole nozzle according to FIGS. 1 to 3 except that a blind hole-shaped recess 8 is provided between the valve seat 3 and the spray hole 4, into which the tip 9 of the nozzle needle 2 penetrates. Whereas, in FIG. 4, the spray hole 4 enters the recess 8 centrally to the injector axis x, it is arranged eccentrically in FIGS. 5 and 6, the length L and orientation of the spray hole 4 as well as the angle a corresponding to the data given in the description of FIG. 1.

Figure 7:
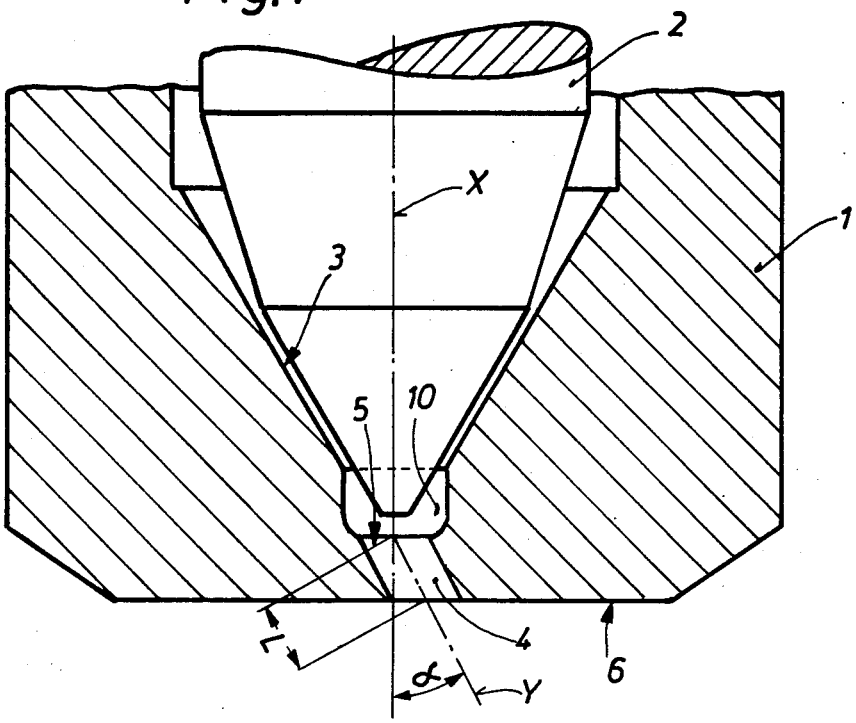
FIG. 7 is a longitudinal section through the lower part of an injector according to the invention with a blind hole-type nozzle hole.
Figure 8:
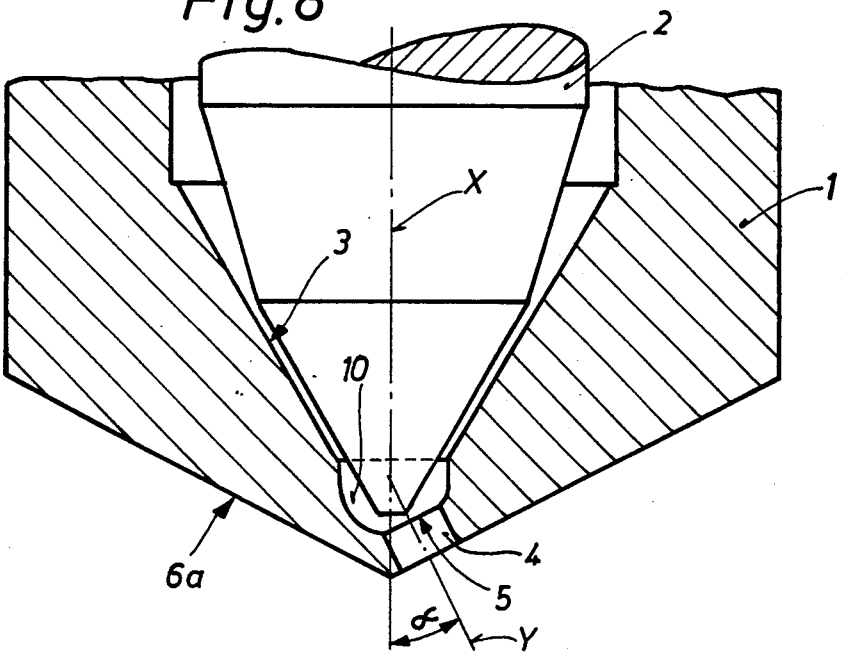
FIG. 8 is a variant of the injector with a blind hole-type nozzle hole according to FIG. 7.

Finally, FIGS. 7 and 8 illustrate the arrangement according to the invention where blind hole type nozzles are used. Here the end of the nozzle needle 2 plunges into a blind hole-shaped recess 10.

The spray hole 4 in FIG. 7 again joins the blind hole 10 centrally, whereas in FIG. 8 it is arranged excentrically. Otherwise, the details given in FIGS. 1 to 3B apply regarding the spray hole 4.

While the invention has been described and illustrated with reference to exemplary embodiments, it is not be considered limited thereto. Any obvious modifications or changes are intended to be encompassed within the scope of the appended claims.

I claim:

1. A fuel injector for internal combustion engines in which an axially slidable single nozzle needle is provided in a nozzle body, said nozzle needle being capable of being lifted off its valve seat by the pressure of the fuel with a single contact cross-section spray hole provided in the nozzle body extending at an acute angle relative to the injector axis characterized in that the angle between the injector axis and the spray hole axis is between 10° and 50° and in that the length of the spray hole axis measured from the penetration area on a blind hole or valve seat respectively to the outer face of the nozzle body is selected so that when looking through the spray hole in the direction of the injector axis, at least 20% of the full spray hole area appears as a free area, the length of the spray hole axis being selected smaller than or at the most equal to twice the spray hole diameter.

2. A fuel injector as defined in claim 1, wherein the outer face of the nozzle body at which the spray hole discharges, is formed as a plane face positioned perpendicular to the injector axis.

3. A fuel injector as defined in claim 1, wherein the outer face of the nozzle body at which the spray hole discharges, is formed as a conical face arranged symmetrical to the injector axis.

4. A fuel injector as defined in claim 1, wherein the outer face of the nozzle body at which the spray hole discharges, is formed as a non-symmetrical conical face or as a plane face extending obliquely to the injector axis.

* * * * *